United States Patent [19]

Baruffa et al.

[11] Patent Number: 4,567,837

[45] Date of Patent: Feb. 4, 1986

[54] SEWING MACHINE

[75] Inventors: Olindo Baruffa, Thonex; Antonio Jimenez, Meyrin, both of Switzerland

[73] Assignee: Mefina S.A., Fribourg, Switzerland

[21] Appl. No.: 563,759

[22] Filed: Dec. 21, 1983

[30] Foreign Application Priority Data

Dec. 23, 1982 [CH] Switzerland ..... 7536/82

[51] Int. Cl.[4] ..... D05B 55/16

[52] U.S. Cl. ..... 112/221

[58] Field of Search ..... 112/221, 158 R

[56] References Cited

U.S. PATENT DOCUMENTS 979,451 12/1910 Eames ..... 112/221 X
1,162,987 12/1915 DeVoe ..... 112/158 R
1,574,184 2/1926 Brigham et al. ..... 112/221 X
3,734,039 5/1973 Krasnitz et al. ..... 112/221 X

FOREIGN PATENT DOCUMENTS 21322 of 1894 United Kingdom ..... 112/221

*Primary Examiner*—Wm. Carter Reynolds
*Attorney, Agent, or Firm*—Emory L. Groff, Jr.

[57] ABSTRACT

A sewing machine includes a stud carried by a journal surrounding a tubular needle bar having a lateral opening. A link connected to the journal normally drives the needle bar when the stud is engaged within the needle bar opening. A disconnecting rod within the tubular needle bar is axially displaceable and includes a ramp engageable with a control member, also within the needle bar, to drive the stud from the needle bar opening and thereby disengage the journal from the needle bar.

7 Claims, 7 Drawing Figures

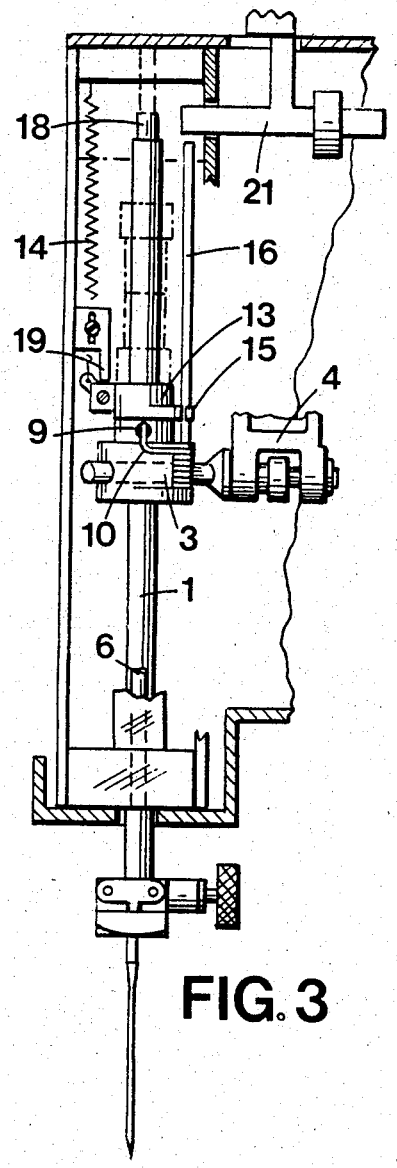
FIG. 3
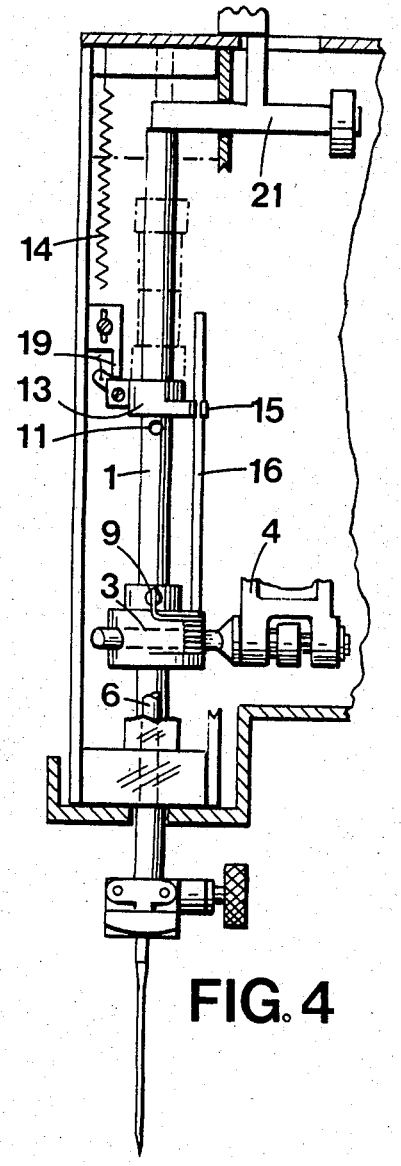
FIG. 4
FIG. 7
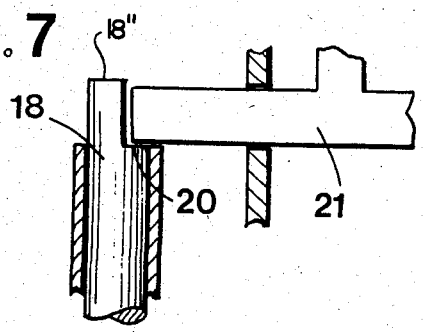

SEWING MACHINE

The invention has for its object a sewing machine in which the longitudinal back and forth movement of a tabular needle bar, designed to carry a needle, is assured by a spindle connected to a link driven by an eccentric plate mounted on the drive shaft of the machine.

In order to execute certain utilitarian stitches (for example the tailor stitch) or decorative (on a zig-zag stitch sewing machine), it is desirable that the needle pierce some elongated stitches in both a continuous or occasional manner.

One already knows, from U.S. Pat. No. 3,815,529, of an engagement and disengagement means for the needle bar of a zig-zag stitch sewing machine which resorts to a complex mechanism and allows the disconnecting of the needle bar only in an extreme lateral position of the needle bar.

In order to remedy this inconvenience, the sewing machine, according to the invention, which comprises a more simple mechanism, is characterized in that the tubular needle bar presents a lateral opening in which can be engaged a stud for locking the needle bar to the spindle connected to the link with a closing device for the lateral opening mounted on the interior of the needle bar and operable by a disconnecting member forming a part of the needle bar.

The attached drawing shows schematically and by way of example a form of execution of the machine according to the invention.

FIG. 3 is a view similar to the needle bar shown in FIG. 1 in an active sewing position.

FIG. 4 is a view similar to FIG. 3 showing the needle bar in disengaged position.

FIG. 7 shows a modification of the disengagement member of the needle bar.

Figures 1, 2:
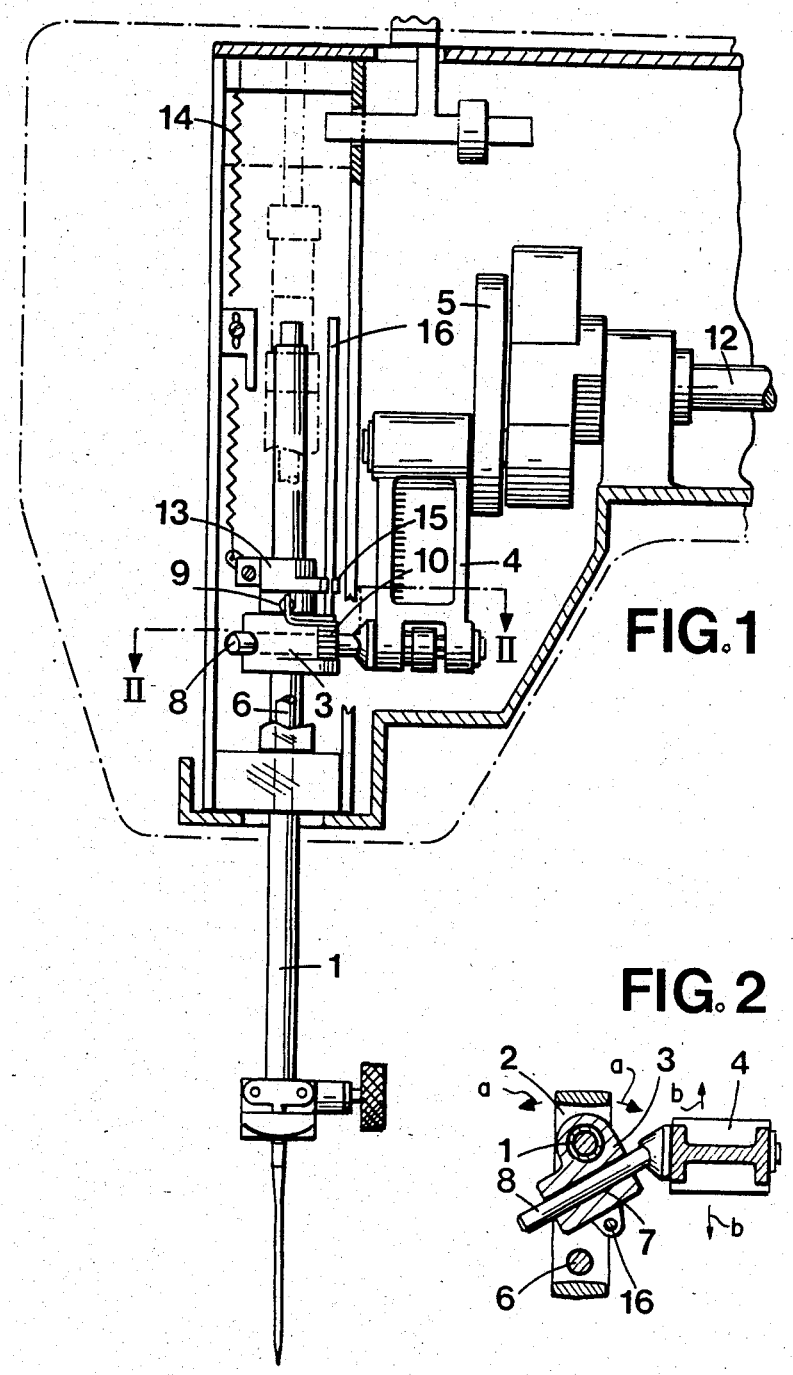
FIG. 1 is a partial longitudinal section view of the head of the machine, showing the needle bar in an active sewing position.
FIG. 2 is partial sectional view according to II—II of FIG. 1.

As shown in FIGS. 1 and 2, the needle bar 1, which is tubular, is mounted in a sliding manner in a cradle 2 and engaged by a surrounding journal 3, coupled to a link 4 for driving the needle bar 1. The cradle is pivotally mounted on an oscillating axle 6 while the journal 3 includes a bore 7 in which is engaged a rod 8 connected to the link 4.

As shown in FIGS. 1 to 5, a stud 9 submitted to the action of the spring 10 is engaged in lateral opening 11 in the tubular wall of the needle bar 1 when in the normal sewing position, in order to assure back and forth longitudinal driving of the needle bar by the link 4 as driven by an eccentric plate 5 on the main drive shaft 12 of the machine. As the cradle 2 oscillates about the axle 6 in the direction of the arrows a—a and the rod 8 slides within the bore 7, resultant differences in angular disposition of the rod 8 are accommodated by minor displacement of the lower portion of the link 4 as reflected by the arrows b—b in FIG. 2.

A tightening collar 13 is made integral with the needle bar 1 above the opening 11. It is connected by a spring 14 to the top of the head of the machine and presents a guiding fork 15 engaging a guide rod 16 made integral with journal 3 parallel to needle bar 1, in order to prevent any rotation of the latter in position of disengagement.

Figure 5:
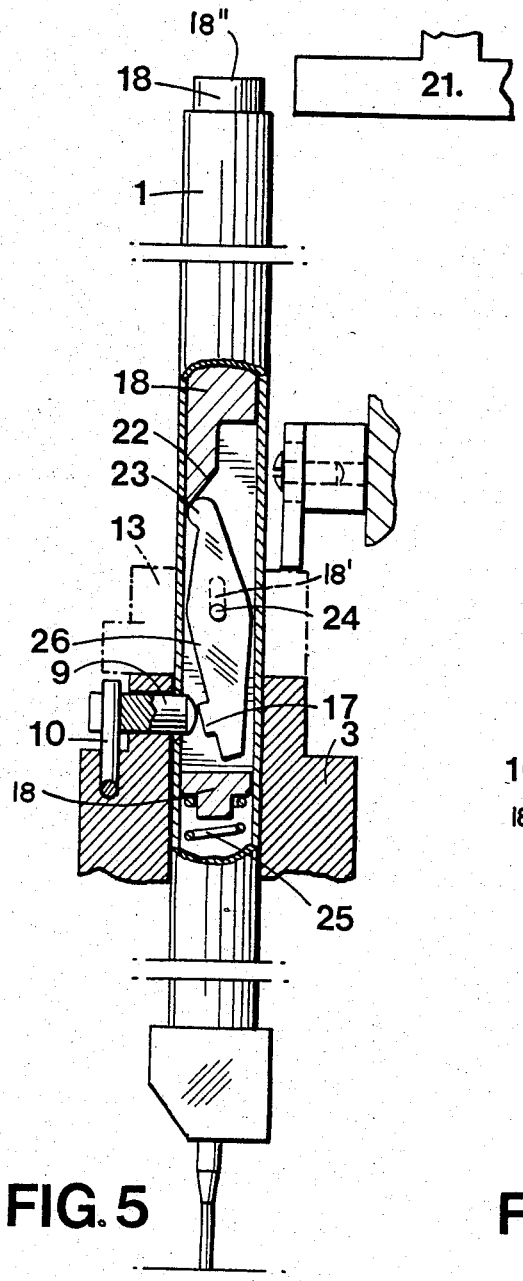
FIG. 5 is a view on a larger scale partially in axial section of the needle bar shown in FIG. 3.
Figure 6:
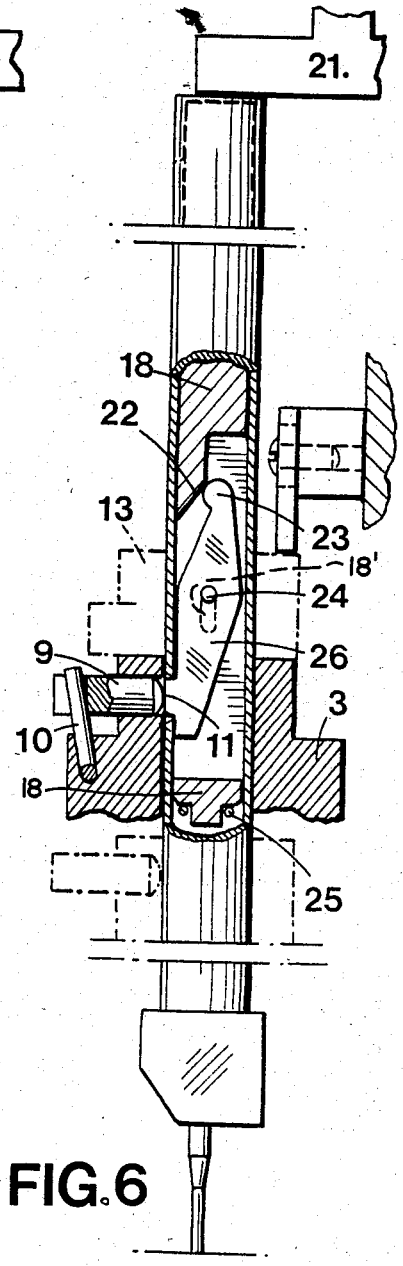
FIG. 6 is a view similar to FIG. 3 showing the needle bar in a disengaged position.

As shown in FIGS. 5 and 6, a control member 26 for disengaging the needle bar 1 is pivotally mounted on a transverse axle 24 in the interior of the needle bar 1. A disconnecting rod 18 presents a ramp 22, which when inserted, against the action of a return spring 25, between the internal wall of the needle bar 1 and the head 23 of the control member 26 causes it to pivot on an axle 24 disposed transversely in the needle bar 1. In this manner, the stop 17 of the control member 26 pushes back the stud 9 out of the opening 11 against the action of the spring 10. The result is that the journal 3 slides on the needle bar 1, which stays in an upper position under action of an spring 14, its tightening collar 13 being retained by the stop 19.

The disconnection of the needle bar 1 can be controlled manually by means of a slide block 21, against which the rod 18 strikes in a first position of the latter, driving the rod and slots 18′ formed therein downwardly to the position of FIG. 6.

According to a modification shown in FIG. 7, it is possible to do away with the stop 19 by cutting a notch 20 in the upper end or extendable portion 18 of the rod 18. As a result, in a second position of the slide block 21, the ramp 22 of the rod is removed from the head 23 of the rocker or control member 26 under the effect of the spring 25, while the needle bar 1 is maintained in connecting position by the slide block 21. Afterward, the slide block 21 can be totally removed to a third position whereby the spring 25 projects the rod 18 and its slots 18′ upwardly to permit the control member 26 and stud 9 to assume the position of FIGS. 3 and 5.

Instead of being operated manually, the displacement of the slide block 21 can be controlled by mechanical means, electromagnetic means or other means. It is well to note that, when the slide block 21 is placed in an active position, that is to say opposite the disconnecting rod 18, the needle bar is always immobilized in an upper position involving, as a consequence, a stopping of the needle away from the cloth to be sewn.

This particularity can cover a remarkable application in order to insure that the needle will always be immobilized in an upper position away from the cloth to be sewn, at each stopping of the sewing machine, at the time of sewing, for example at the instant when one cuts off the supply of electric current to the sewing machine.

We claim:

1. A sewing machine, in which back and forth longitudinal movement of a tubular needle bar, designed to carry a needle, is assured by a journal surrounding the needle bar and connected to a link driven by an eccentric plate mounted on the main drive shaft of the machine, characterized in that said tubular needle bar is provided with a lateral opening, a transversely displaceable stud carried by said journal and engageable within said opening to lock said needle bar to said journal to permit normal back and forth longitudinal movement of said needle bar as said drive shaft is operated, a shiftable control member having a stop and mounted within the interior of said needle bar, a disconnecting rod within the interior of said needle bar movable axially to shift said stop to displace said stud from said lateral opening to provide disengagement between said journal and needle bar.

2. A sewing machine according to claim 1 including an axle transversely mounted within said needle bar, said control member comprising an elongated member pivotally supported upon said axle and having a head adjacent one end and said stop adjacent an opposite end, said disconnecting rod provided with a ramp juxtaposed said control member head whereby, axial movement of said disconnecting rod ramp toward said control member head pivotally shifts said control member about said axle to produce said displacement of said stud from said needle bar opening.

3. A sewing machine according to claim 1 including, slidable means movable to a first position adapted to abut said disconnecting rod at the time of ascent of said needle bar to produce said displacement of said stud from said needle bar opening.

4. A sewing machine according to claim 2 including, slidable means movable to a first position adapted to abut said disconnecting rod at the time of ascent of said needle bar to produce said displacement of said stud from said needle bar opening.

5. A sewing machine according to claim 3 wherein, said disconnecting rod includes an extendable portion projectable from the top of said needle bar, a notch formed in said extendable portion of said disconnecting rod and said slideable means movable to a second position adapted to abut said notch whereby said stop does not displace said stud from said lateral opening.

6. A sewing machine according to claim 4 wherein, said disconnecting rod includes an extendable portion projectable from the top of said needle bar, a notch formed in said extendable portion of said disconnecting rod and said slideable means movable to a second position adapted to abut said notch whereby said stop does not displace said stud from said lateral opening.

7. A sewing machine according to claim 1 including, a guide rod integral with said journal and a guide fork integral with said needle bar and slidably engaging said guide rod in order to prevent any rotation of said needle bar around its longitudinal axis.

* * * * *